US008667944B2

(12) United States Patent
Beyer

(10) Patent No.: US 8,667,944 B2
(45) Date of Patent: Mar. 11, 2014

(54) CYLINDER HEAD ASSEMBLY HAVING AN OIL ROUTING PLUG

(75) Inventor: Theodore Beyer, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 146 days.

(21) Appl. No.: 13/237,812

(22) Filed: Sep. 20, 2011

(65) Prior Publication Data

US 2013/0068189 A1 Mar. 21, 2013

(51) Int. Cl.
*F01L 1/46* (2006.01)

(52) U.S. Cl.
USPC ..... 123/193.5; 123/90.38

(58) Field of Classification Search
USPC ..... 123/90.34, 90.38, 90.15–90.17, 196 R, 123/193.5
See application file for complete search history.

(56) References Cited

U.S. PATENT DOCUMENTS

| | | | | | |
|---|---|---|---|---|---|
| 4,537,166 | A * | 8/1985 | Kimura et al. | ..... | 123/90.36 |
| 4,823,747 | A * | 4/1989 | Wagner et al. | ..... | 123/193.5 |
| 5,150,675 | A * | 9/1992 | Murata | ..... | 123/193.5 |
| 5,163,872 | A | 11/1992 | Niemiec et al. | | |
| 6,035,817 | A * | 3/2000 | Uchida | ..... | 123/90.17 |
| 6,532,930 | B2 | 3/2003 | Kobayashi et al. | | |
| 6,729,284 | B2 | 5/2004 | Lunsford | | |
| 6,871,620 | B2 | 3/2005 | Aimone | | |
| 6,968,813 | B2 | 11/2005 | Isobe et al. | | |
| 7,818,113 | B2 | 10/2010 | Kajiwara et al. | | |
| 8,225,764 | B2 * | 7/2012 | Yoon et al. | ..... | 123/90.27 |

* cited by examiner

*Primary Examiner* — M. McMahon
(74) *Attorney, Agent, or Firm* — Julia Voutyras; Alleman Hall McCoy Russell & Tuttle LLP

(57) ABSTRACT

An engine provided herein. The engine includes a cylinder head assembly, a cap including an opening, an oil routing plug positioned in the opening including a recess traversing the plug, the recess and a portion of the wall of the opening defining a boundary of a plug oil passage, and an oil supply passage extending through the cylinder head assembly including an inlet fluidly coupled to a lubrication circuit and an outlet opening into the recess.

18 Claims, 11 Drawing Sheets

CYLINDER HEAD ASSEMBLY HAVING AN OIL ROUTING PLUG

BACKGROUND/SUMMARY

Variable cam timing is used in engine to increase combustion efficiency over a wide range of engine operating conditions. For example, intake and/or exhaust valve timing may be advanced or retarded based on various operating conditions such as engine temperature, requested power output, revolutions per minute (RPM), etc., to increase combustion efficiency. As a result, the engine's power output may be increased and emissions may be reduced. Opening for components, such as cam timing solenoid valves, as well as other components used to control a cam phaser configured to alter the timing of an intake or exhaust camshaft may be integrated into the cylinder head. Specifically, openings for solenoid valves and/or oil feed lines may be machined or cast into the cylinder head to route oil to the cam phaser.

However, the Inventors have recognized several drawbacks with casting and machining the aforementioned features into the cylinder head. Firstly, when the features are integrated into the cylinder head, the cylinder head may only be used in engines having variable cam timing. Thus, the engine's design is specialized. As a result, the cylinder head may only be used in specific types of engines, thereby limiting the applicability of the cylinder head and increasing the production cost of the cylinder head.

As such in one approach, an engine provided herein. The engine includes a cylinder head assembly, a cap including an opening, an oil routing plug positioned in the opening including a recess traversing the plug, the recess and a portion of the wall of the opening defining a boundary of a plug oil passage, and an oil supply passage extending through the cylinder head assembly including an inlet fluidly coupled to a lubrication circuit and an outlet opening into the recess.

In this way, oil may be routed through an oil routing plug positioned in an opening. It will be appreciated that that opening may also be configured to receive a solenoid valve instead of an oil routing plug in other embodiments. As a result, the applicability of the cylinder block assembly is increased, thereby decreasing production costs.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE FIGURES

FIGS. 4-11 are drawn approximately too scale.

DETAILED DESCRIPTION

An engine having cylinder head assembly is provided herein. The cylinder head assembly may include a cap including an opening. An oil routing plug may be positioned in the opening and include a plug oil passage configured to receive oil from an engine lubrication system and flow oil to a journal oil passage adjacent to a journal bearing rotatably coupled to a camshaft. It will be appreciated that the opening may house other components in other embodiments. For example, a solenoid valve may be positioned in the opening. In this way, the cylinder head assembly may be modified at a late stage in the production, increasing the cylinders heads applicability and decreasing manufacturing costs of the engine.

Figure 1:
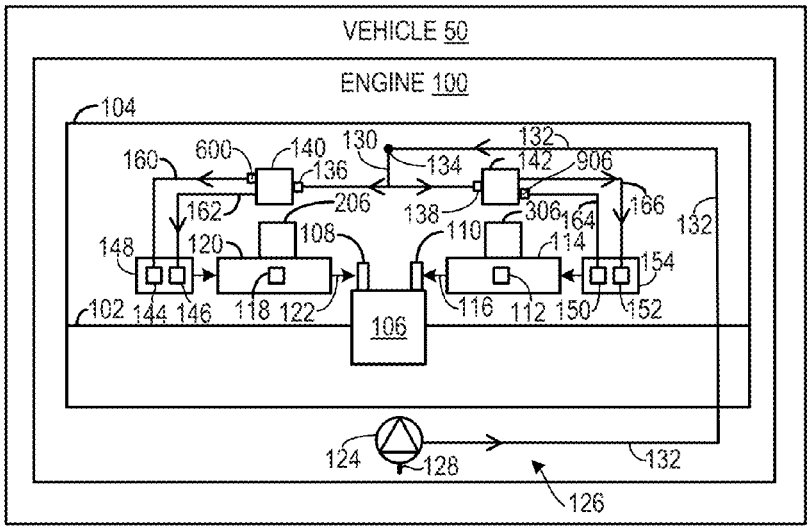
FIGS. 1-3 show schematic depictions of three different embodiments of an engine.
Figure 2:
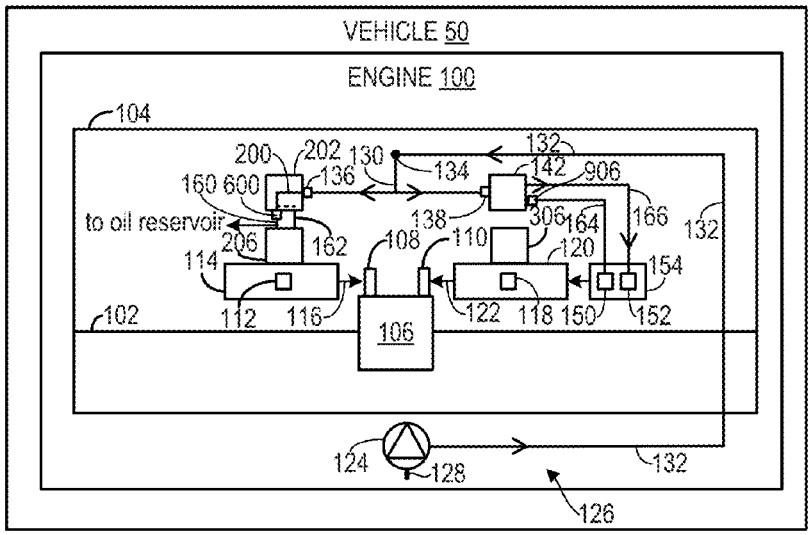
Figure 3:
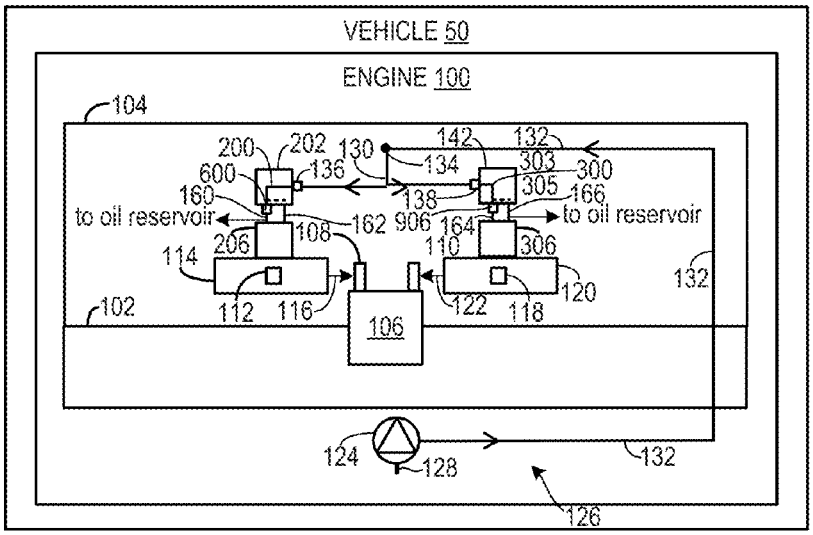

FIGS. 1-3 show schematic depictions of three embodiments of a vehicle 50 including an engine 100. The three embodiments of the vehicle 50 having the engine 100 may include common components, therefore similar parts are labeled accordingly. When two components are referred to as the "same" it will be appreciated that the geometries, configurations, etc., of the separate components are substantially identical. In other words, the components may be built to the same design specifications. Furthermore, the various engine embodiments shown in FIGS. 1-3 may be included in a product line. Therefore, each of the vehicle's embodiments shown in FIGS. 1-3 may be included in a product line. Thus, similar components in the engines in the product line, such as the caps, may be the same. It will be appreciated that the engine 100 may include common components that area easily modified to meet desired design specifications at a late stage in the manufacturing process to reduce manufacturing costs.

FIG. 1 shows a schematic depiction of a first embodiment of the engine 100. As shown, the engine 100 includes a cylinder block assembly 102 and a cylinder head assembly 104. The cylinder block assembly 102 and the cylinder head assembly 104 may form a combustion chamber 106. It will be appreciated that in other embodiments the cylinder head assembly 104 and the cylinder block assembly 102 may form a plurality of combustion chambers.

The combustion chamber 106 may include an exhaust valve 108 and an intake valve 110. The intake valve 110 may be actuated via a lobe 112 included in an intake camshaft 114. Arrow 116 depicts the actuation of the intake valve 110 via the lobe 112. Likewise the exhaust valve 108 may be actuated via a lobe 118 included in an exhaust camshaft 120. Arrow 122 depicts the actuation of the exhaust valve 108 via the lobe 118. In this way, the intake and exhaust valves (110 and 108) may be actuated at desired time intervals. Additionally, the camshaft 120 may be rotatably coupled to a first journal bearing 206 and the camshaft 114 may be coupled to a second journal bearing 306. The intake valve 110 may be fluidly coupled to an intake system configured to provide intake air to the combustion chamber and the exhaust valve 108 may be fluidly coupled to an exhaust system configured to receive exhaust gas from the combustion chamber 106 and flow to the exhaust gas to the surrounding atmosphere. The engine 100 may be operated to perform 4 strokes: intake, compression, combustion, and exhaust, in some embodiments. It will be appreciated that the engine may include additional components that are not depicted for performing combustion, such as a fuel injector configured to supply metered fuel to the combustion chamber 106, a piston coupled to a crankshaft, a spark plug, etc.

A pump 124 may be included in an engine lubrication system 126. The pump 124 may include a pick-up 128 configured to draw oil from an oil reservoir, such as an oil pan (not shown). An oil supply passage 130 may be fluidly coupled to the engine lubrication system 126. Specifically, in the depicted embodiment the oil supply passage 130 is fluidly coupled to the pump 124 via oil passage 132 traversing the cylinder block assembly 102 and the cylinder head assembly 104. However, in other embodiments, oil passage 132 may not traverse the cylinder block assembly 102 and/or the cylinder head assembly 104. Additional lubrication passages configured to lubricate various engine components may also be included in the engine lubrication system 126 that are not depicted.

The oil supply passage 130 includes an inlet 134 fluidly coupled to the engine lubrication system 126. The oil supply passage 130 further includes a first outlet 136 and a second outlet 138. The first and second outlets (136 and 138) may also be referred to as supply outlets. In the embodiment depicted in FIG. 1 the first outlet 136 is fluidly coupled to a first solenoid valve 140 via a first journal oil passage 160 and a second journal oil passage 162. The first and/or second journal oil passages may be referred to as oil supply passages. The first journal oil passage 160 may include an inlet 600. Additionally, the first solenoid valve 140 may be positioned in an opening 900 shown in FIG. 9 in some embodiments. Specifically, the first journal oil passage 160 is fluidly coupled to an advance circuit 144 in the solenoid valve 140 and the second journal oil passage 162 is fluidly coupled to a retard circuit 146 in the cam phaser 148. Likewise, the second outlet 138 is fluidly coupled to a second solenoid valve 142 via a third journal oil passage 164 and a fourth journal oil passage 166. The third journal oil passage 164 may include an inlet 906 shown in FIG. 9. The first and/or second solenoid valve (140 and 142) may be variable cam timing solenoids. Additionally, the first solenoid valve may be positioned in opening 900, shown in FIG. 9, second solenoid valve 142 may be positioned in opening 902, shown in FIG. 9, in some embodiments. The first and second solenoid valves (140 and 142) may substantially seal the openings (900 and 902). Furthermore, the third journal oil passage 164 is fluidly coupled to an advance circuit 150 in a second cam phaser 154. The first solenoid valve 140 is configured to adjust the amount of oil provided to an advance circuit 144 as well as a retard circuit 146 in the exhaust cam phaser 148. The exhaust cam phaser 148 may be configured to adjust the timing of the exhaust camshaft 120. For example, the lobe 118 may be advanced or retarded based on engine operating conditions.

The second solenoid valve 142 is configured to adjust the amount of oil provided to the advance circuit 150 as well as the retard circuit 152 in the intake cam phaser 154. The intake cam phaser 154 may be configured to adjust the timing of the intake camshaft 114. However, it will be appreciated that in other embodiments, the first solenoid valve 140 may be configured to adjust the amount of oil provided to an intake cam phaser and the second solenoid valve 142 may be configured to adjust the amount of oil provided to an exhaust cam phaser.

FIG. 2 shows a second embodiment of the engine 100. As shown, the second outlet 138 is fluidly coupled to the solenoid valve 142 as shown in FIG. 1. However, the first outlet 136 is fluidly coupled to a plug oil passage 200 routed through an oil routing plug 202. The oil routing plug 202 may be positioned in an opening such as opening 900, shown in FIG. 9. The oil routing plug 202 may seal the opening and provide the plug oil passage 200. The oil routing plug 202 may also be referred to as a plug. The boundary of the plug oil passage 200 may be defined by a recess in the oil routing plug 202 and a wall, discussed in greater detail herein.

The plug oil passage 200 may be fluidly coupled to the journal oil passage 160 configured to provide oil to a journal bearing 206 and a camshaft journal. Additionally, in some embodiments the plug oil passage 200 may be fluidly coupled to a second journal oil passage 162 configured to provide oil to the journal bearing 206. However, in other embodiments, oil may be substantially inhibited from flowing into the second journal oil passage 162 from the plug oil passage 200.

The first and/or second journal oil passages (160 and 162) may be fluidly coupled to additional oil passages in the engine lubrication system 126. Moreover, it will be appreciated that the oil may be directed back to the oil reservoir from the first and/or second journal oil passages (160 and 162).

FIG. 3 shows a third embodiment of engine 100. As shown, the second outlet 138 is fluidly coupled to a second plug oil passage 300 routed through a second oil routing plug 302. It will be appreciated that the second oil routing plug 302 may have a substantially similar construction (geometry, size, material, etc.) to the first oil routing plug 202 in some embodiments. The boundary of the second plug oil passage 300 may be defined by a recess in the oil routing plug 202 and a wall.

The second plug oil passage 300 may be fluidly coupled to a third journal oil passage 164 configured to provide oil to a second journal bearing 306. Additionally, in some embodiments the second plug oil passage 304 may be fluidly coupled to a fourth journal oil passage 166 configured to provide oil to the second journal bearing 306 and a camshaft journal. However, in other embodiments, oil may be substantially inhibited from flowing into the fourth journal oil passage 166 from the second plug oil passage 300.

The third and/or fourth journal oil passages (164 and 166) may be fluidly coupled to additional oil passages in the engine lubrication system 126. Moreover, it will be appreciated that the oil may be directed back to the oil reservoir from the third and/or fourth journal oil passages (164 and 166).

Figure 4:
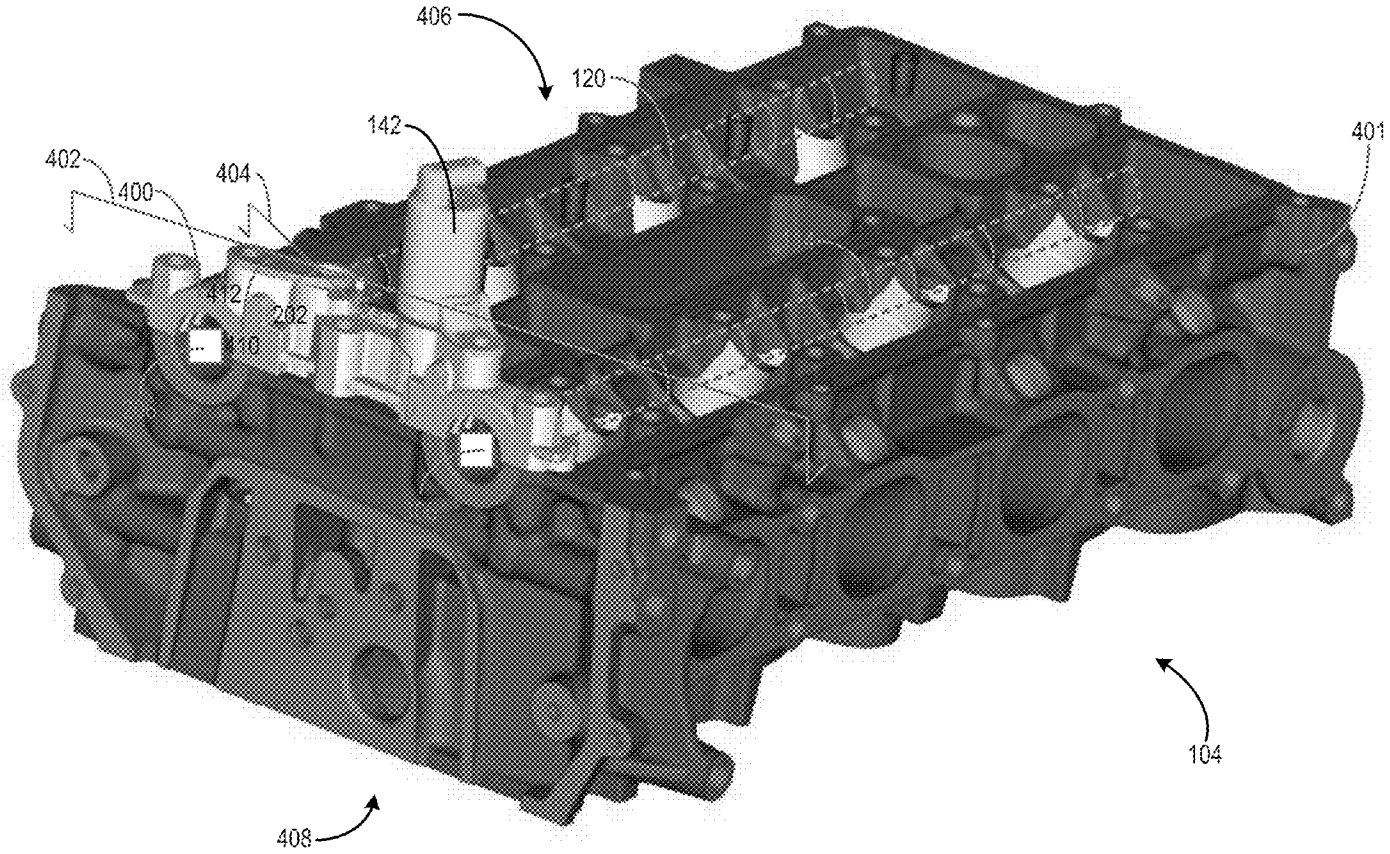
FIG. 4 shows an illustration of an embodiment of the cylinder head assembly included in the engine shown in FIG. 2.
Figure 5:
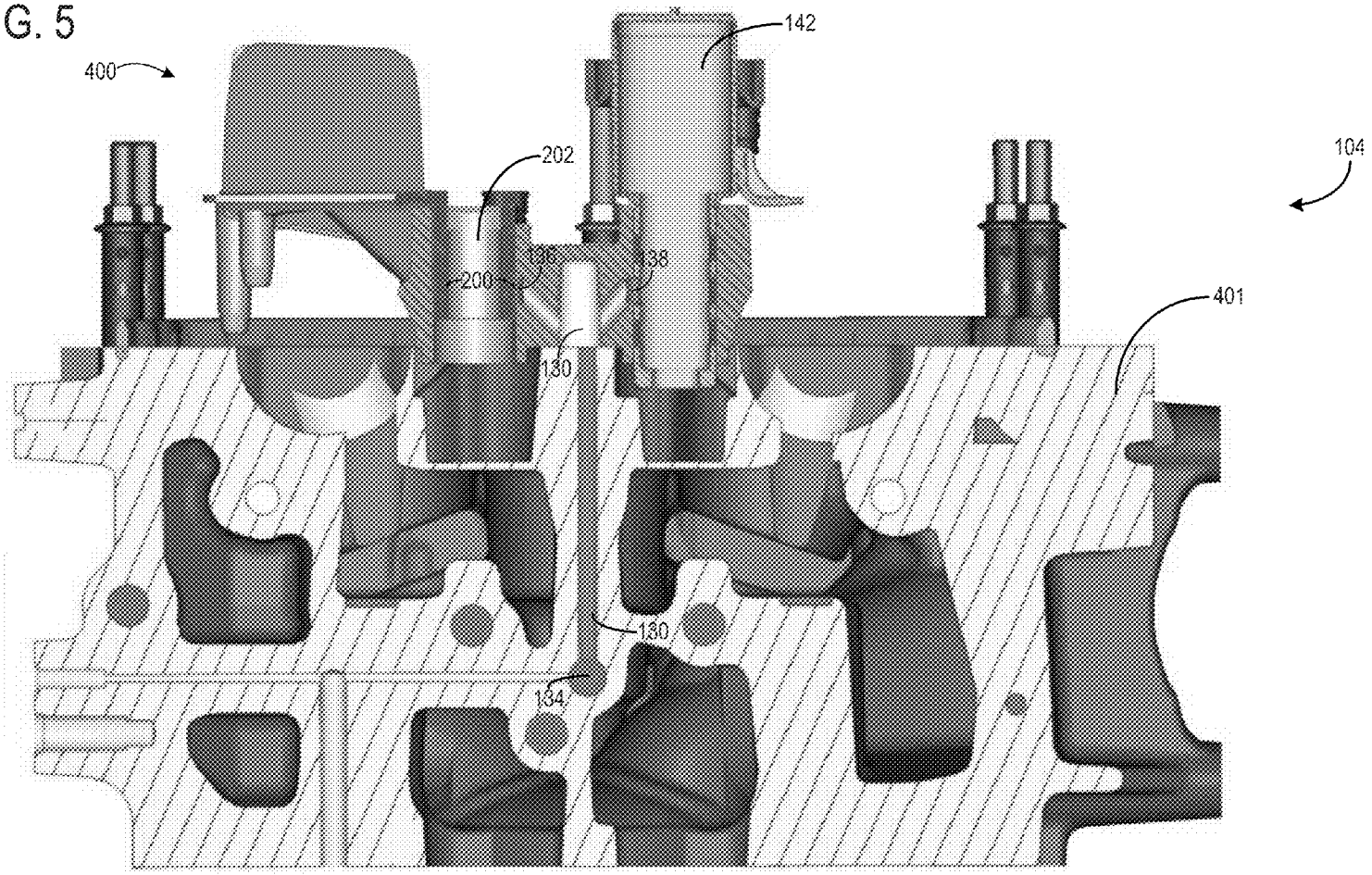
FIG. 5 shows a cross-sectional view of the cylinder head assembly shown in FIG. 4.
Figure 6:
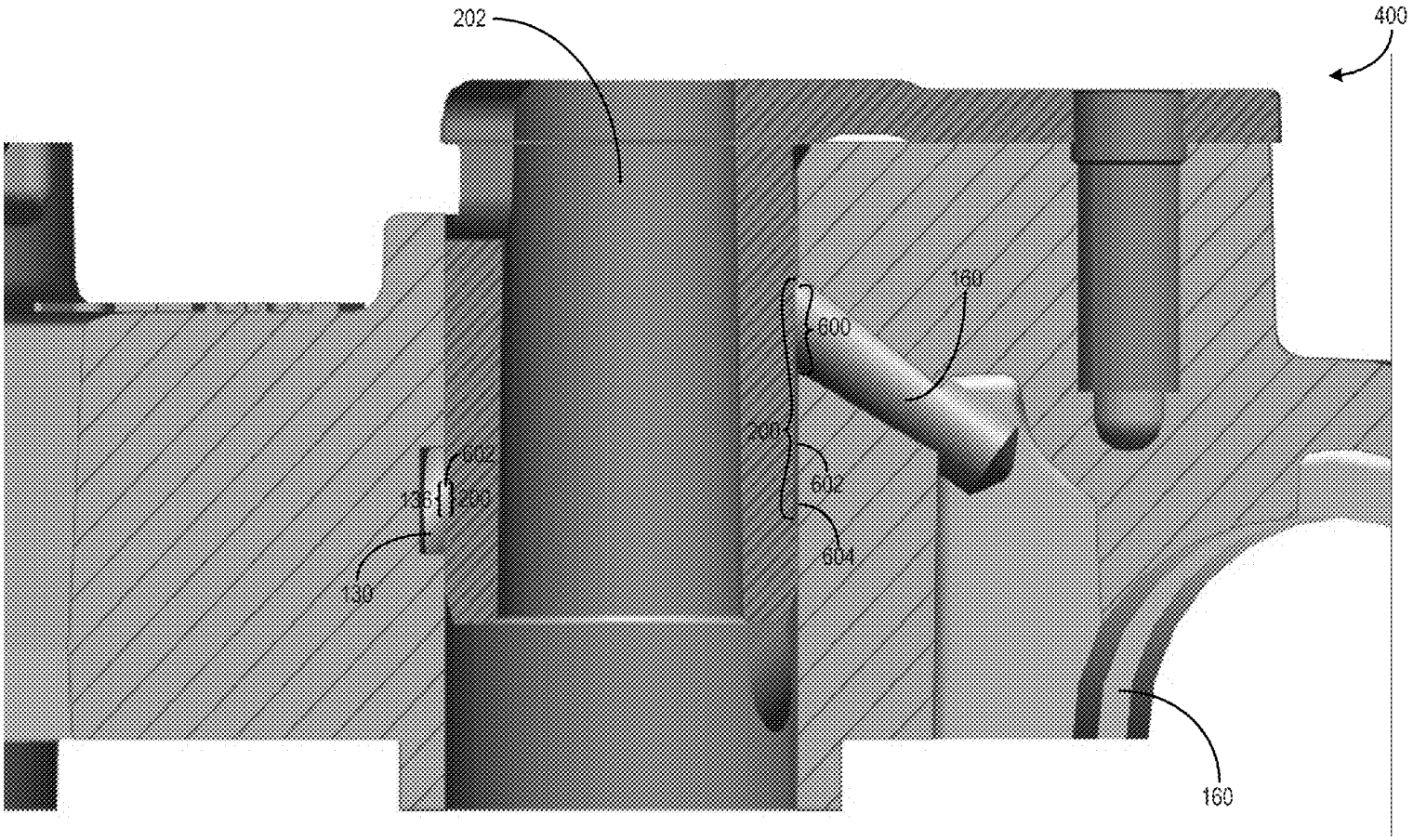
FIG. 6 shows a view of the cap included in the cylinder head assembly shown in FIG. 4.

FIGS. 4-11 show illustrations of the second embodiment of the cylinder head assembly 104 included in the engine 100 shown in FIG. 2. FIG. 4 shows a perspective view of the cylinder head assembly 104 including cylinder head 401. As shown the cylinder head assembly includes a cap 400 coupled to the cylinder head assembly 104. In the depicted embodiment the cap 400 and the cylinder head 401 are separate components that are manufactured separately (e.g., cast) and then coupled to one another. However, in other embodiments the cap 400 may be part of the cylinder head 401. Thus, the cap 400 and the cylinder head 401 may be manufactured via a single casting, in some embodiments. It will be appreciated that in some embodiments the cylinders head may be constructed via casting. The oil routing plug 202 may be positioned in an opening 900 in the cap 400, shown in FIG. 9. Continuing with FIG. 4, in some embodiments the oil routing plug 202 may be constructed out of a different material than the cylinder head 401. However, in other embodiments the oil routing plug 202 and the cylinder head 401 may be constructed out of a similar material. The solenoid valve 142 may be positioned in a second opening 902 in the cap 400, shown in FIG. 9. Continuing with FIG. 4, the first journal bearing 206 and the second journal bearing 306 may be included in the cylinder head assembly 104, as previously discussed. The first journal bearing 206 may be rotatably coupled to the exhaust camshaft 120. Likewise, the second journal bearing 306 may be rotatably coupled to the intake camshaft 114. As previously discussed the camshafts may include one or more lobes configured to actuate valve(s) coupled to combustion chamber(s) in the engine 100. Although the journal bearings are generally depicted with boxes it will be appreciated that a variety of suitable bearings may be utilized. The cross-section shown in FIG. 5 is defined by cutting plane 402 and the cross-section shown in FIG. 6 is defined by cutting plane 404. Additionally, a cam cover may be coupled to a top 406 of the cylinder head assembly 104, in some embodiments. The cylinder block assembly 102, shown in FIGS. 1-3, may be coupled to a bottom 408 of the cylinder head assembly 104.

The oil routing plug 202 also includes a mounting extension 410 radial extending from an end of the oil routing plug 202 and including an attachment apparatus 412 configured to attach to the cylinder head assembly 104. The mounting extension enables the oil routing plug 202 to be aligned in a desired position during manufacturing without undue visual inspection.

FIG. 5 shows a cross-sectional view of the cylinder head assembly 104. The oil supply passage 130 is shown extending through the cylinder head 401. In the depicted embodiment the oil supply passage 130 extends vertically through the cylinder head 401. However, in other embodiments other routing is possible. Additionally, a portion of the oil supply passage 130 extends through the cap 400 and a portion of the oil supply passage extends through the cylinder head 401.

The oil supply passage 130 includes the inlet 134 and a first outlet 136 opening into the plug oil passage 200 included in the oil routing plug 202. The plug oil passage 200 is shown in greater detail in FIG. 6, discussed in greater detail herein. The journal oil passage 160 is fluidly coupled to the plug oil passage 200. The oil supply passage 130 further includes a second outlet 138 fluidly coupled to solenoid valve 142. As previously discussed the solenoid valve 142 is configured to adjust the amount of oil provided to the cam phaser 154, shown in FIG. 2.

FIG. 6 shows a cross-sectional view of the cap 400. The first outlet 136 is again shown fluidly coupled to the plug oil passage 200. Additionally, the journal oil passage 160 includes an inlet 600 fluidly coupled to the plug oil passage 200. In this way, oil may be routed from the oil supply passage 130 to the plug oil passage 200 and from the plug oil passage 200 to the journal bearing 206. The boundary of the plug oil passage 200 is defined by a recess 602 included in the oil routing plug 202 and a wall 604 defining the boundary of the opening 900, shown in FIG. 9, included in the cap 400. It will be appreciated that a portion of an outer surface of the oil routing plug 202 is in face sharing contact with the wall 604. In this way, oil may be contained within the plug oil passage, and thereby substantially inhibited from leaking out of the oil routing plug 202. The recess 602 circumferentially traverses the oil routing plug 202, in the depicted embodiment. However, other configurations are possible in other embodiments.

Figure 7:
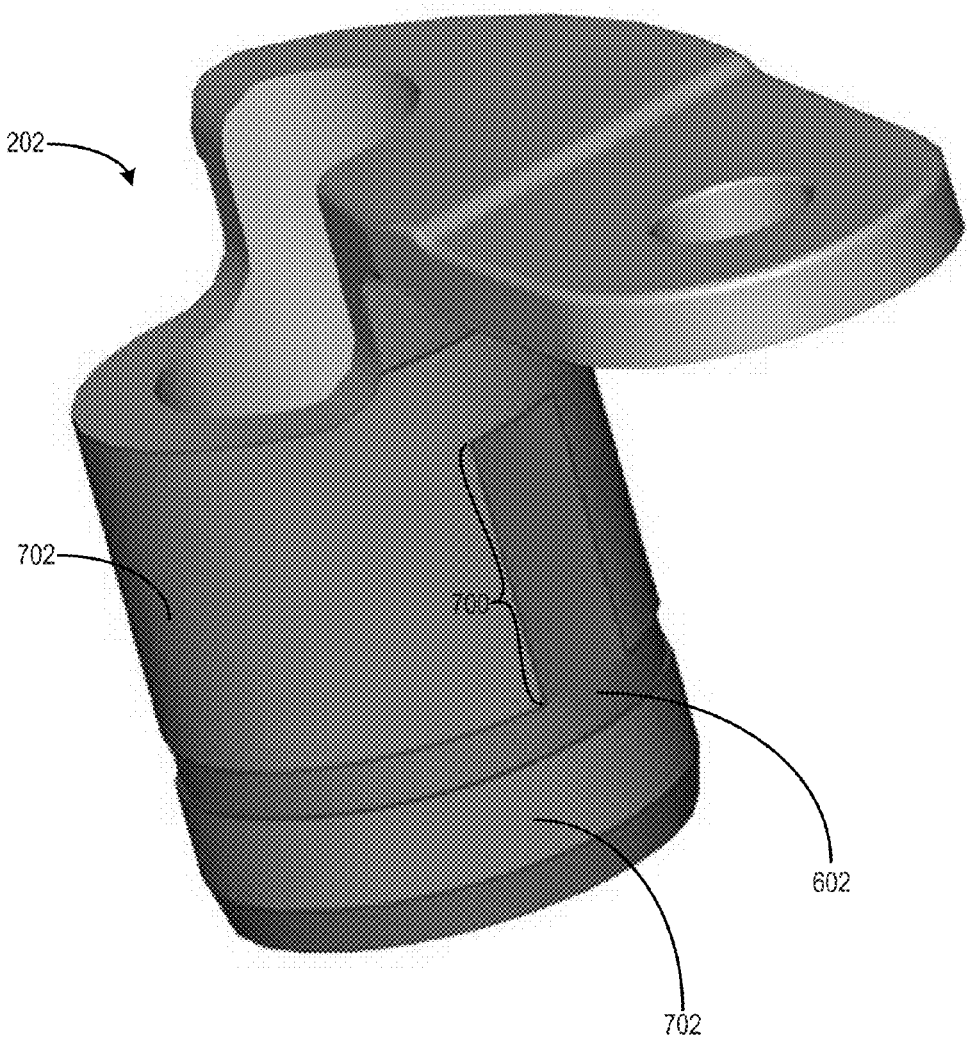
FIG. 7 shows a view of a first embodiment of an oil routing plug included in the cylinder head assembly shown in FIG. 4.

FIG. 7 shows an illustration of the oil routing plug 202. As shown the recess 602 circumferentially extends around the oil routing plug 202 a full 360 degrees. However, in other embodiments, the recess may only partially extend around the oil routing plug 202. The recess 602 includes a vertical portion 700 extending in an axial direction. It will be appreciated that the inlet 600, shown in FIG. 6, may open into the vertical portion 700. In this way, out may be directed to downstream components. Likewise, the oil routing plug also includes a non-recessed portion 702 that may be in face sharing contact with wall 604, shown in FIG. 6.

Figure 8:
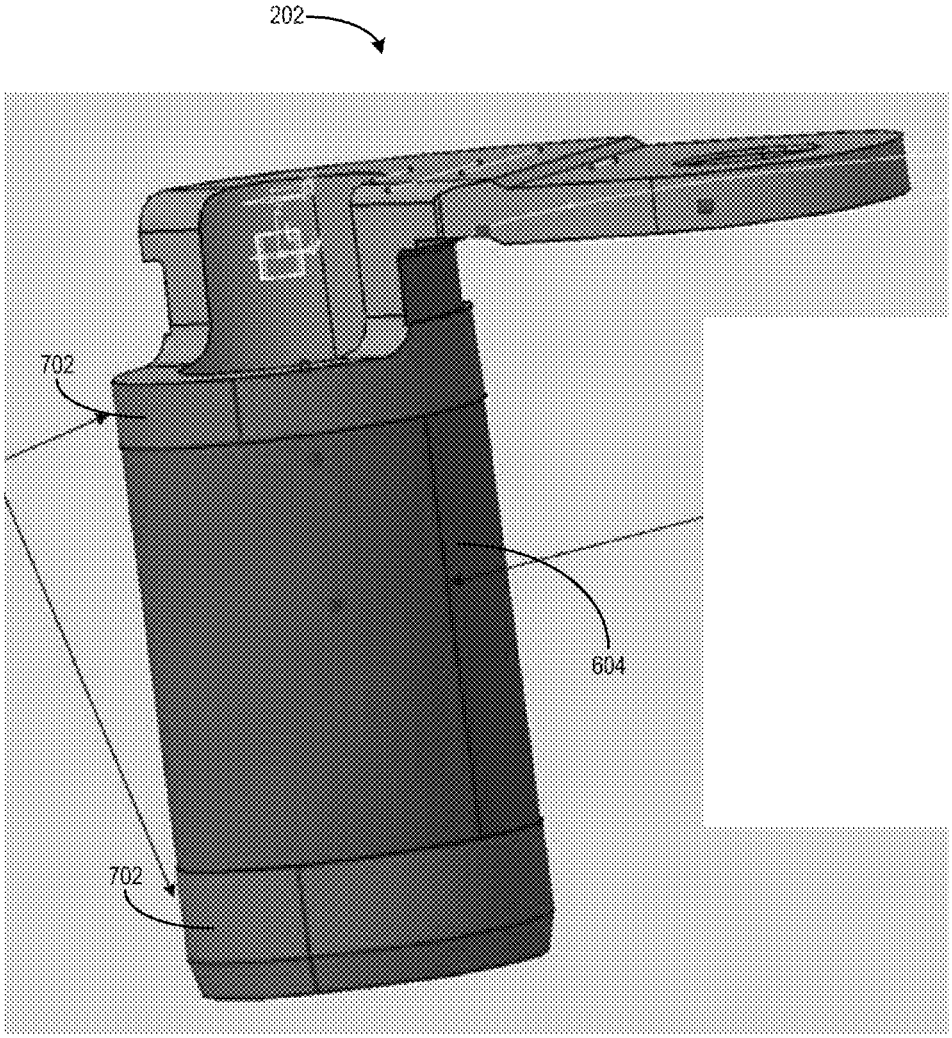
FIG. 8 shows a second embodiment of an oil routing plug included in the cylinder head assembly shown in FIG. 4.

FIG. 8 shows a second embodiment of the oil routing plug 202. As shown the axial length of the oil routing plug 202 is extended and the side of the recess 602 is increased. Specifically, the axial distance of the portion of the recess 602 circumferentially extending around the oil routing plug is increased. Therefore, the size of the non-recessed portion 702 is decreased. As a result, oil may be directed to the second journal oil passage 162, shown in FIG. 2, from the oil routing plug 202. It will be appreciated that when a solenoid is positioned in the opening the first and second journal oil passages flow oil to a retard and advance circuit in a cam phaser 154, shown in FIG. 2. In this way, portions of the cylinder head assembly 104 may be modified late in the assembly process. As a result, the production cost of the product line may be decreased.

Figure 9:
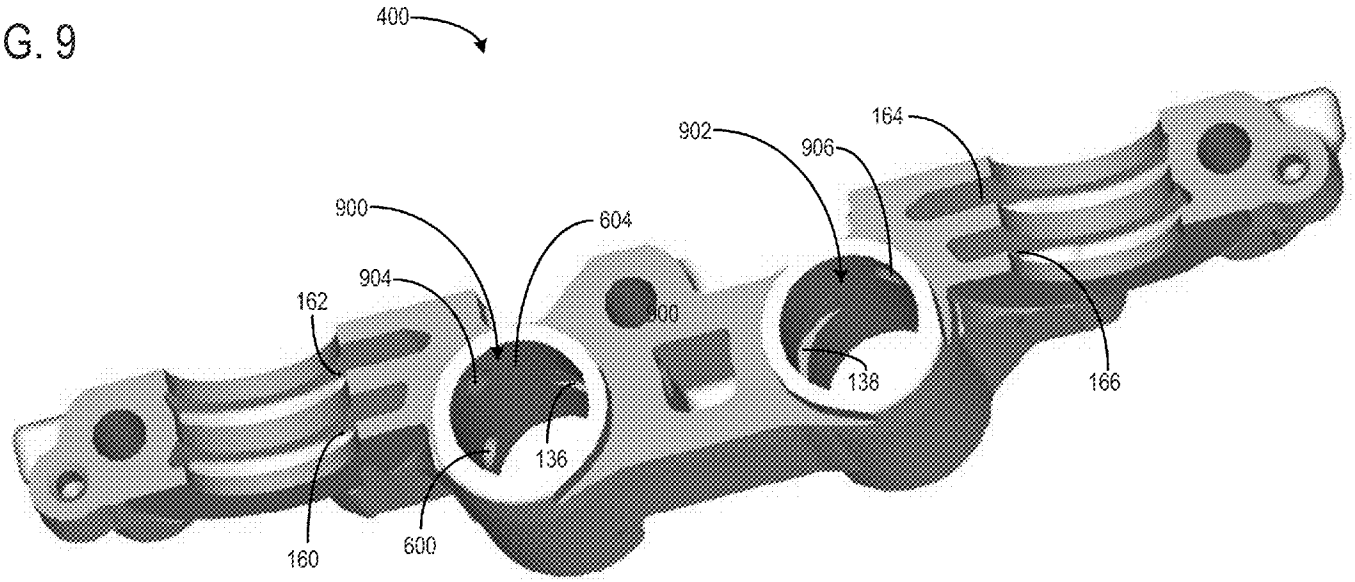
FIG. 9 shows an illustration of the cap included in the cylinder head assembly shown in FIG. 4 excluding an oil routing plug and a solenoid valve.

FIG. 9 shows an illustration of the cap 400 without the oil routing plug 202 or solenoid valve 142. In this illustration, the first opening 900 and the second opening 902 can be clearly seen. It will be appreciated that both the oil routing plug 202 and the solenoid valve 142, shown in FIG. 4 may be positioned in the openings (900 and 902) when the cylinder head assembly 104, shown in FIG. 4, is assembled. The openings (900 and 902) may be positioned in the top of the cylinder block assembly and may vertically extend into the cap. However, it will be appreciated that other orientations are possible. Additionally, the first opening 900 is adjacent to the first journal bearing 206 and the second opening 902 is adjacent to the second journal bearing 306.

The inlet 600 of the first journal oil passage 160 is shown. Likewise, the inlet 904 of the second journal oil passage 162 is shown. The first and second journal oil passages traverse a portion of the cap 400 configured to house the journal bearing 206 rotatably coupled to the exhaust camshaft 120, shown in FIG. 2. Specifically, the first and second journal oil passages (160 and 162) may circumferentially traverse at least portion of the journal bearing 206. In this way, lubrication is provided to the journal bearing 206, thereby decreasing the likelihood of thermal degradation of the journal bearing.

The first outlet 136 and the second outlet 138 of the oil supply passage 130 is also shown. Furthermore, the inlet 906 of the third journal oil passage 164 is also shown. Additionally, the fourth journal oil passage 166 is also shown. The third journal oil passage 164 and the fourth journal oil passage 166 may circumferentially traverse at least portion of the second journal bearing 306. In this way, lubrication is provided to the second journal bearing 306, thereby decreasing the likelihood of thermal degradation of the second journal bearing.

Figure 10:
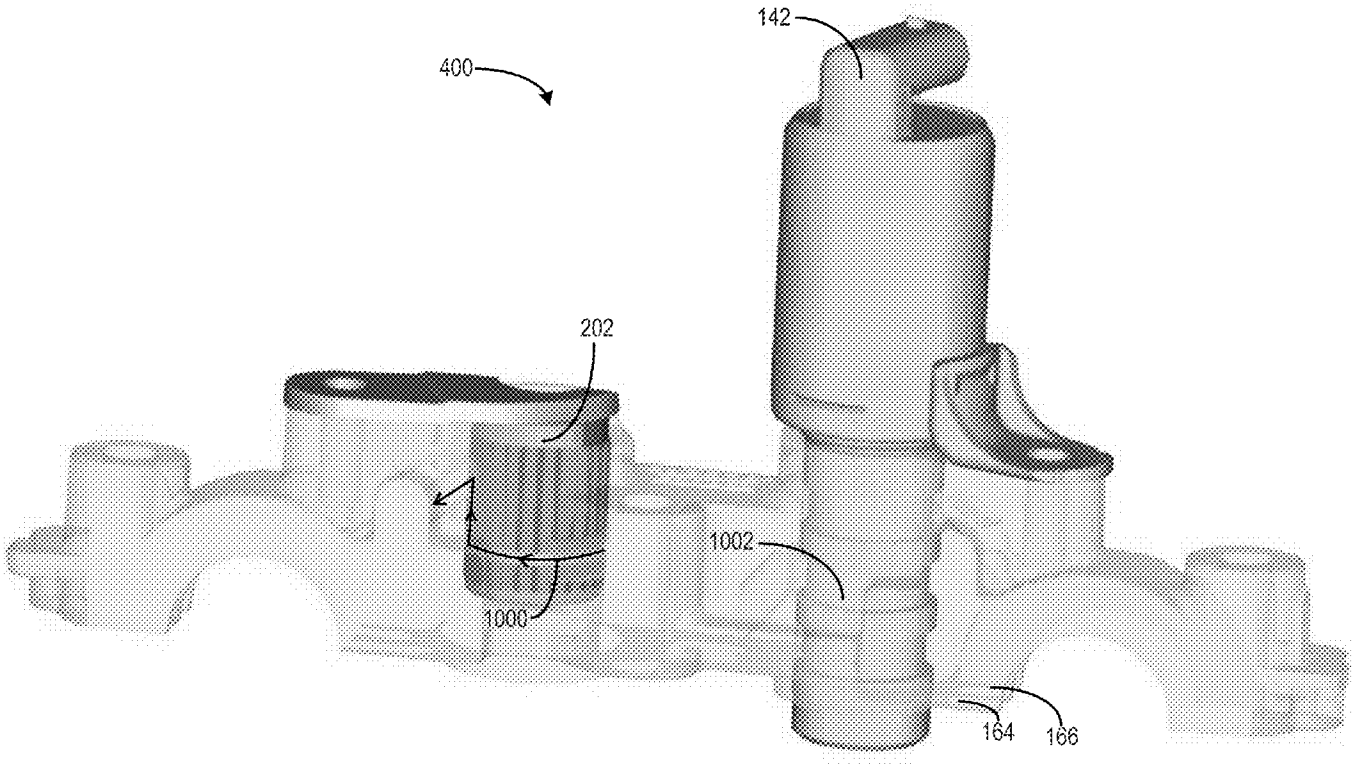
FIGS. 10 and 11 show illustrations of the cap included in the cylinder head assembly shown in FIG. 4.
Figure 11:
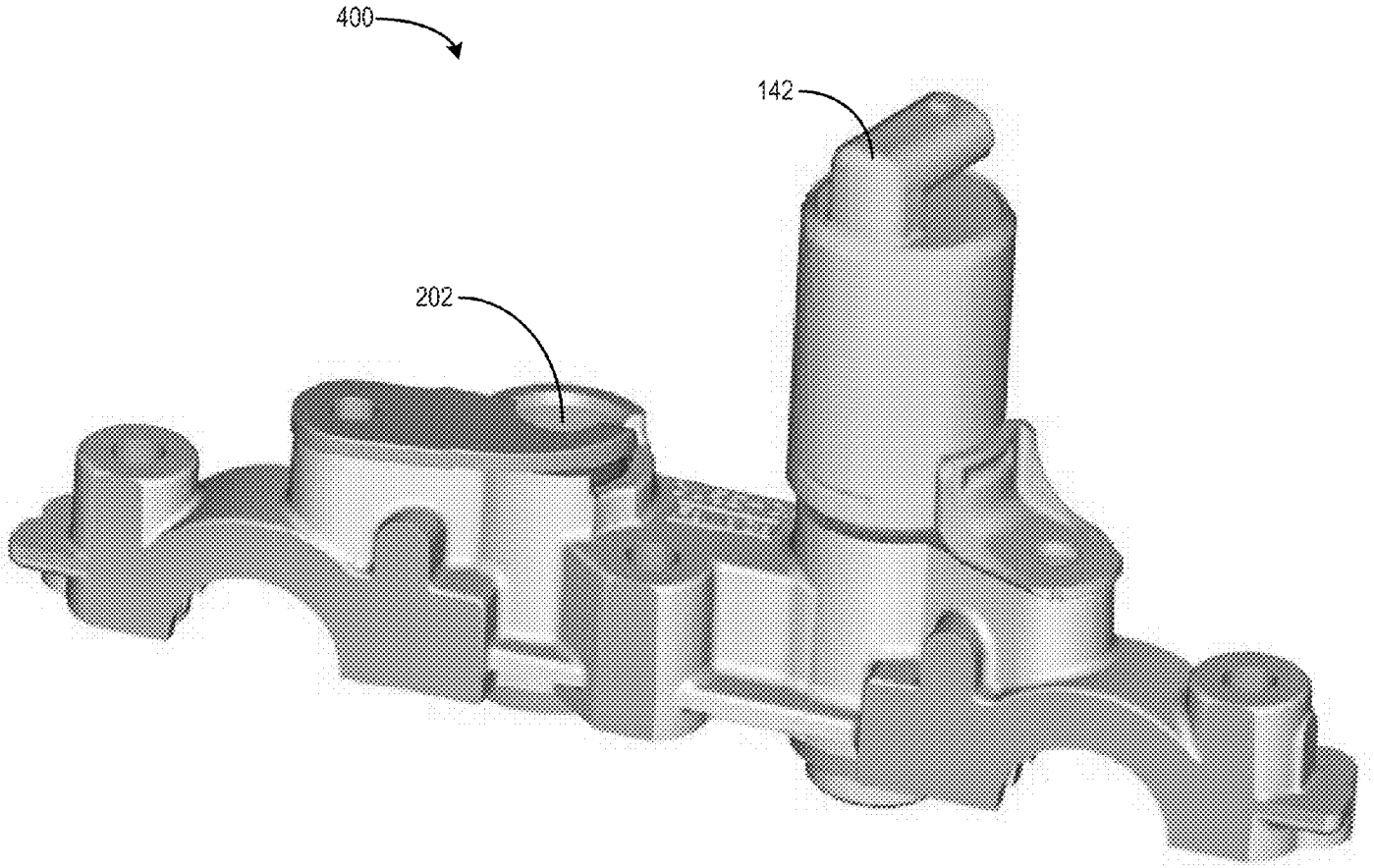

FIG. 10 shows an illustration of the cap 400, the oil routing plug 202, and the solenoid valve 142. Arrow 1000 depicts the general flow path of oil through the plug oil passage 200. However, it will be appreciated that the oil flow may have additional complexity that is not depicted. Additionally, the solenoid valve 142 includes a shaft 1002. The solenoid valve 142 may be configured to actuate the shaft in an axial direction to control the flow of oil to the third and fourth journal oil passage (164 and 166). FIG. 11 shows another illustration of the cap 400, the oil routing plug 202, and the solenoid valve 142.

Figure 12:
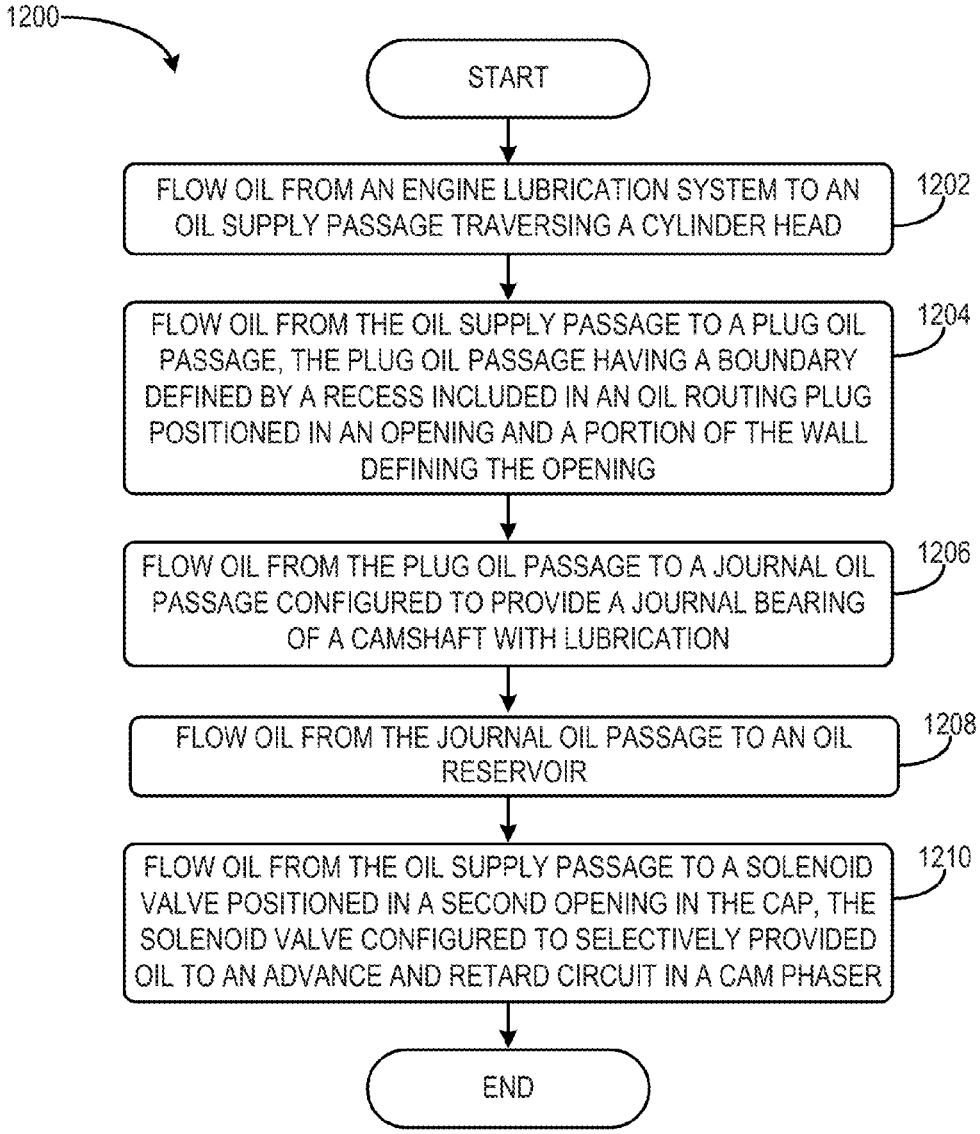
FIGS. 12 and 13 show two methods for operation of an engine.

FIG. 12 shows a method 1200 for operation of an engine. The engine 100 described above may be used to implement the method 1200 in some embodiments. Specifically, method 1200 may be implemented via the embodiment of engine 100 shown in FIG. 2. However, in other embodiments another suitable engine may be used to implement method 1200.

At 1202 the method includes flowing oil from an engine lubrication system to an oil supply passage traversing a cylinder head. Next at 1204 the method includes flowing oil from the oil supply passage to a plug oil passage, the plug oil passage having a boundary defined by a recess included in an oil routing plug positioned in an opening and a portion of the wall defining the opening.

At 1206 the method includes flowing oil from the plug oil passage to a journal oil passage configured to provide a journal bearing of a camshaft with lubrication. The camshaft may be an exhaust camshaft in some embodiments. However, in other embodiments the camshaft may be an intake camshaft. At 1208 the method includes flowing oil from the journal oil passage to an oil reservoir.

Next, at 1210 the method includes flowing oil from the oil supply passage to a solenoid valve positioned in a second opening in the cap, the solenoid valve configured to selectively provided oil to an advance and retard circuit in a cam phaser. The cam phaser may be configured to adjust the timing of a second camshaft.

Figure 13:
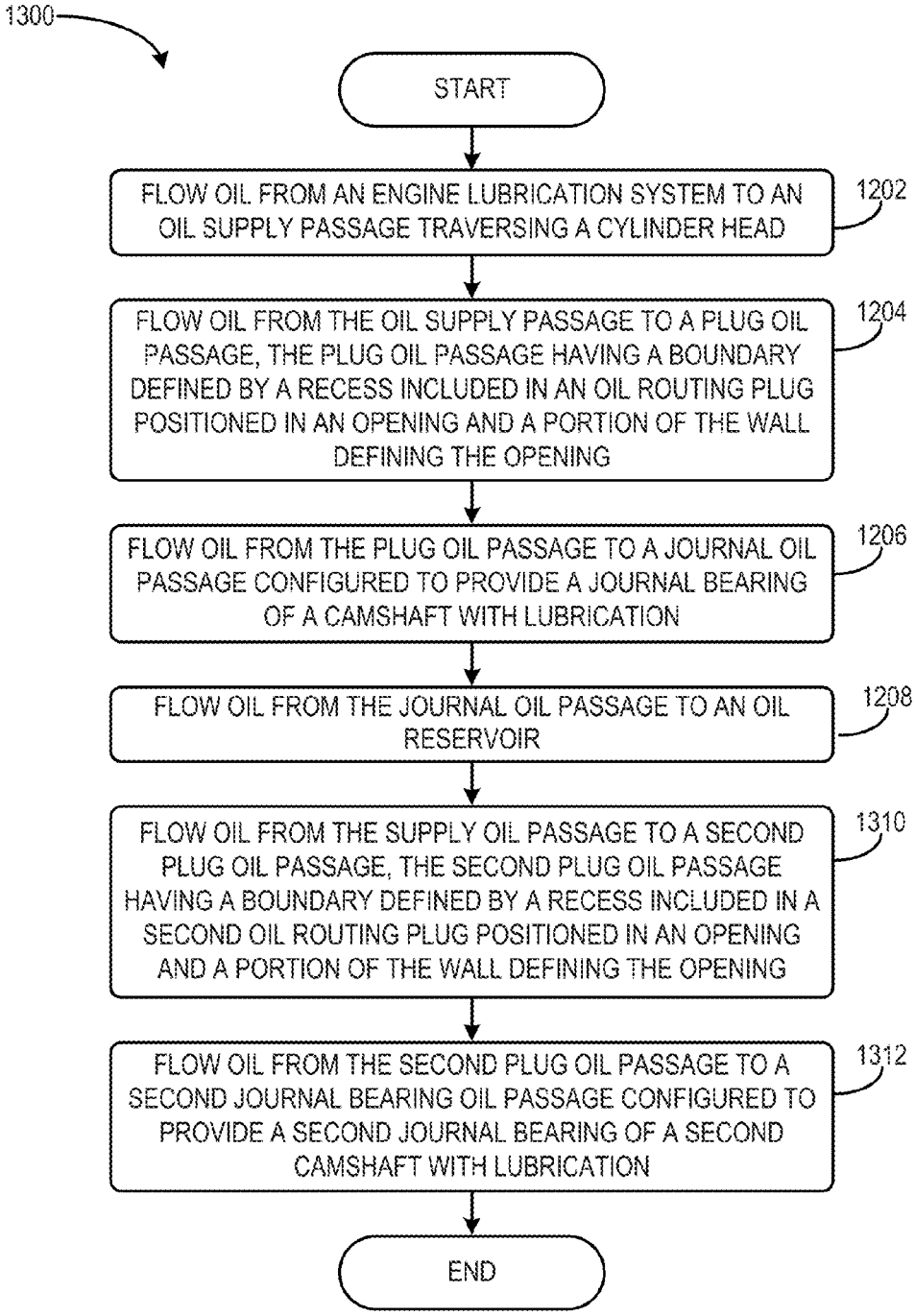

FIG. 13 shows another method for operation of an engine. Specifically, method 1300 may be implemented via the embodiment of engine 100 shown in FIG. 3. However, in other embodiments another suitable engine may be used to implement method 1300. Method 1300 includes steps that are similar to steps in method 1200. Therefore, corresponding steps are labeled accordingly.

At 1310 the method includes flowing oil from the supply oil passage to a second plug oil passage, the second plug oil passage having a boundary defined by a recess included in a second oil routing plug positioned in an opening and a portion of the wall defining the opening.

At 1312 the method includes flowing oil from the second plug oil passage to a second journal bearing oil passage configured to provide a second journal bearing of a second camshaft with lubrication.

It will be appreciated that the configurations and/or approaches described herein are exemplary in nature, and that these specific examples or examples are not to be considered in a limiting sense, because numerous variations are possible. The subject matter of the present disclosure includes all novel and nonobvious combinations and subcombinations of the various features, functions, acts, and/or properties disclosed herein, as well as any and all equivalents thereof.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine comprising:
a cylinder head assembly;
a cap including an opening:
an oil routing plug positioned in the opening including a recess traversing the plug, the recess and a portion of a wall of the opening defining a boundary of a plug oil passage; and
an oil supply passage extending through the cylinder head assembly including an inlet fluidly coupled to a lubrication circuit, an outlet opening into the recess, and a second outlet opening into a solenoid valve positioned in a second opening in the cap.

2. The engine of claim 1, wherein the cap includes a journal oil passage fluidly coupled to the plug oil passage and a journal bearing.

3. The engine of claim 2, further comprising a camshaft rotatably coupled to the journal bearing.

4. The engine of claim 2, wherein the cap includes a second journal oil passage fluidly coupled to the plug oil passage and the journal bearing.

5. The engine of claim 2, wherein the cap includes a second journal oil passage having an inlet, a portion of the cap blocking the inlet.

6. The engine of claim 3, wherein the camshaft is an exhaust camshaft configured to actuate exhaust valves in the engine.

7. The engine of claim 1, wherein the recess circumferentially traverses the oil routing plug.

8. The engine of claim 1, wherein the oil routing plug includes a non-recessed surface in face sharing contact with another portion of the wall of the opening.

9. The engine of claim 1, wherein the solenoid valve is an oil control valve configured to adjust an amount of oil provided to a cam retard oil passage and a cam advance oil passage.

10. The engine of claim 1, wherein the oil routing plug includes a mounting extension radially extending from an end of the plug and including an attachment apparatus configured to the cylinder head.

11. An engine comprising:
a cylinder head assembly;
a cap including an opening:
an oil routing plug positioned in the opening including a recess traversing the plug, the recess and a portion of a wall of the opening defining a boundary of a plug oil passage; and
an oil supply passage extending through the cylinder head assembly including an inlet fluidly coupled to a lubrication circuit, and an outlet opening into the recess, wherein the oil supply passage includes a second opening fluidly coupled to a solenoid valve positioned in a second opening in the cap.

12. The engine of claim 11, wherein the solenoid valve is configured to supply oil to a cam phaser.

13. The engine of claim 12, wherein the solenoid valve is configured to supply oil to an advance and retard circuit in the cam phaser.

14. An engine comprising:
a cylinder head assembly including:
a cylinder head;
a cap coupled to the cylinder head including an opening,
an oil supply passage extending through the cylinder head including an inlet fluidly coupled to an engine lubrication circuit and an outlet;
an oil routing plug positioned in the opening including a plug oil passage having an inlet fluidly coupled to the outlet of the oil supply passage and an outlet fluidly coupled to a journal oil passage; and
a journal oil passage fluidly coupled to the plug oil passage and a journal bearing; and
a solenoid valve positioned in a second opening in the cap, wherein the oil supply passage further includes a second opening fluidly coupled to the solenoid valve.

15. The cylinder head of claim 14, wherein the cap is coupled to a top portion of the cylinder head.

16. The engine of claim 14, wherein the cap includes a journal oil passage fluidly coupled to the plug oil passage and a journal bearing, the journal oil passage at least partially circumferentially traversing the journal bearing.

17. The engine of claim 14, wherein a recess in the oil routing plug and a portion of a wall of the opening define a boundary of the plug oil passage, the recess circumferentially traversing the oil routing plug.

18. The engine of claim 14, wherein the cap and the cylinder head are formed via a single casting.

* * * * *